US005775272A

United States Patent [19]

Matsunaga et al.

[11] Patent Number: 5,775,272

[45] Date of Patent: Jul. 7, 1998

[54] CYLINDER HEAD FOR A MULTI-CLYLINDER INTERNAL COMBUSTION ENGINE

[75] Inventors: Akio Matsunaga, Susono; Makoto Suzuki; Shizuo Abe, both of Mishima, all of Japan

[73] Assignee: Toyota Jidosha Kabushiki Kaisha, Aichi, Japan

[21] Appl. No.: 785,436

[22] Filed: Jan. 17, 1997

[30] Foreign Application Priority Data

Jan. 19, 1996 [JP] Japan ..... 8-007246

[51] Int. Cl.[6] ..... F02F 1/36

[52] U.S. Cl. ..... 123/41.82 R

[58] Field of Search ..... 123/41.82 R

[56] References Cited

U.S. PATENT DOCUMENTS 4,436,066 3/1984 Formia et al. ..... 123/41.82 R 4,962,733 10/1990 Cheung ..... 123/193.5

FOREIGN PATENT DOCUMENTS 0226143 6/1987 European Pat. Off. .

58-82453 6/1983 Japan .

*Primary Examiner*—Noah P. Kamen

*Attorney, Agent, or Firm*—Kenyon & Kenyon

[57] ABSTRACT

According to the present invention, there is provided a cylinder head for a multi-cylinder internal combustion engine, comprising: a bottom wall having an upper face which defines a waterjacket, the bottom wall having spaced recessed wall portions which have lower faces defining upper spaces of adjacent combustion chambers, the bottom wall having a bottom wall portion formed between the recessed wall portions to divide the upper spaces of the adjacent combustion chambers; and slit means formed on the upper face of the bottom wall portion and extending within the bottom wall portion toward a lower face of the bottom wall portion.

9 Claims, 6 Drawing Sheets

CYLINDER HEAD FOR A MULTI-CLYLINDER INTERNAL COMBUSTION ENGINE

BACKGROUND OF THE INVENTION

1. Field of the Invention

The invention relates to a cylinder head for a multi-cylinder internal combustion engine.

2. Description of the Related Art

FIG. 8 is a bottom side view of a conventional cylinder head 10 for a multi-cylinder internal combustion engine. The cylinder head 10 generally comprises a upper wall, side walls and a bottom wall 16. The bottom wall 16 has spaced recessed wall portions 18 and a bottom wall portion 20 formed between the recessed wall portions 18. The recessed wall portions 18 have lower faces 22 defining upper spaces 24 of adjacent combustion chambers (not shown). Each of the recessed wall portions 18 has an intake valve port opening 26 and an exhaust valve port opening 28. The intake valve port openings 26 are arranged on one side of a plane including axes of cylinders of the multi-cylinder engine, and the exhaust valve port openings 28 are arranged on the other side of the plane including axes of the cylinders. The cylinder head 10 is attached to an engine body (not shown) by screwing a bolt or the like into each bolt hole 30 which is provided in the bottom wall 16.

In the multi-cylinder internal combustion engine, the recessed wall portion 18 tends to expand outwardly from the center of the recessed wall portion 18 due to the heat from the combustion chamber during the operation of the engine. The recessed wall portion 18 can expand, in some extent, transversely relative to the plane including the axes of the cylinders and outwardly from the center of the recessed wall portion 18 since there is no element which completely restricts the transverse expansion of the recessed wall portion 18. Therefore, thermal stress derived from the transverse expansion of the recessed wall portion 18 is relatively small. On the other hand, the longitudinal expansion of the recessed wall portion 18 is restricted by the longitudinal expansion of the adjacent recessed wall portion 18 since the recessed wall portions 18 are aligned with each other in the longitudinal direction of the cylinder head 10, and the longitudinal expansion of the adjacent recessed wall portions 18 are opposed to each other. Therefore, thermal stress derived from the opposed longitudinal expansion of the recessed or bottom wall portions 18 or 20 is relatively large.

Further, the thermal stress derived from the longitudinal expansion of the recessed or bottom wall portion 18 or 20 is released when the operation of the engine is stopped, thereby decreasing the temperature of the cylinder head 10. Therefore, after the production and the release of the thermal stress is repeated, thermal fatigue is produced in the recessed or bottom wall portion 18 or 20. The above thermal stress and fatigue produce cracks in the recessed or bottom wall portions 18 or 20.

Accordingly, it is necessary to limit the thermal stress derived from the opposed longitudinal expansion of the recessed or bottom wall portions 18 or 20. For example, in Japanese unexamined utility model publication No. 58-82453, as in FIGS. 9 and 10 showing the cross sectional view of the cylinder head 10, taken along the line II—II of FIG. 8, a slit 32 or a cavity 34 is formed within the bottom wall portion 20 between the recessed wall portions 18 in order to limit the thermal stress derived from the opposed longitudinal expansion of the recessed or bottom wall portions 18 or 20. The slit 32 extends within the bottom wall portion 20 from a lower face 36 of the bottom wall portion 20. The cavity 34 is formed within the bottom wall portion 20.

The opposed longitudinal expansions of the recessed wall portions 18 are restricted especially by the upper portion 38 of the bottom wall portion 20. However, the slit 32 or the cavity 34 is not formed in the upper portion 38 of the bottom wall portion 20. Thus, the opposed longitudinal expansions cannot be absorbed by the slit 32 or cavity 34. Therefore, the production of the thermal stress derived from the opposed longitudinal expansions of the recessed wall portions 18 is not limited by means of the prior art.

Further, the extent of the longitudinal expansion of a portion of the recessed wall portion 18, which is positioned near the exhaust valve port openings 28, is larger than that of a portion of the recessed wall portion 18 which is positioned near the intake valve port openings 26 since the temperature of the portions positioned near the exhaust valve port openings 28 is greater than that of the portions positioned near the intake valve port openings 26. Therefore, the above difference in the extent of the longitudinal expansions produces the cracks in a portion of the recessed wall portion 18 which is positioned between the portions positioned near the exhaust valve port openings 28 and the intake valve port openings 26.

SUMMARY OF THE INVENTION

Accordingly, the object of the invention is to provide a cylinder head for a multi-cylinder internal combustion engine designed to limit the production of the thermal stress derived from the opposed longitudinal expansions of the recessed or bottom wall portions due to the heat from the combustion chamber during the operation of the engine.

Another object of the invention is to provide a cylinder head for a multi-cylinder internal combustion engine designed to limit the production of the thermal stress derived from the difference of the extent of the longitudinal expansions of the portions of the recessed wall portion, which are each positioned near the exhaust valve port openings and the intake valve port openings.

A further object of the invention is to provide a cylinder head for a multi-cylinder internal combustion engine designed to limit the production of the thermal stress derived from the opposed longitudinal expansions and to maintain the rigidity of the cylinder head.

According to the present invention, there is provided a cylinder head for a multi-cylinder internal combustion engine, comprising: a bottom wall having an upper face which defines a waterjacket, the bottom wall having spaced recessed wall portions which have lower faces defining upper spaces of adjacent combustion chambers, the bottom wall having a bottom wall portion formed between the recessed wall portions to divide the upper spaces of the adjacent combustion chambers; and slit means formed on the upper face of the bottom wall portion and extending within the bottom wall portion toward a lower face of the bottom wall portion.

The present invention may be more fully understood from the description of the preferred embodiments of the invention set forth below, together with the accompanying drawings.

DESCRIPTION OF THE PREFERRED EMBODIMENTS

Figure 8:
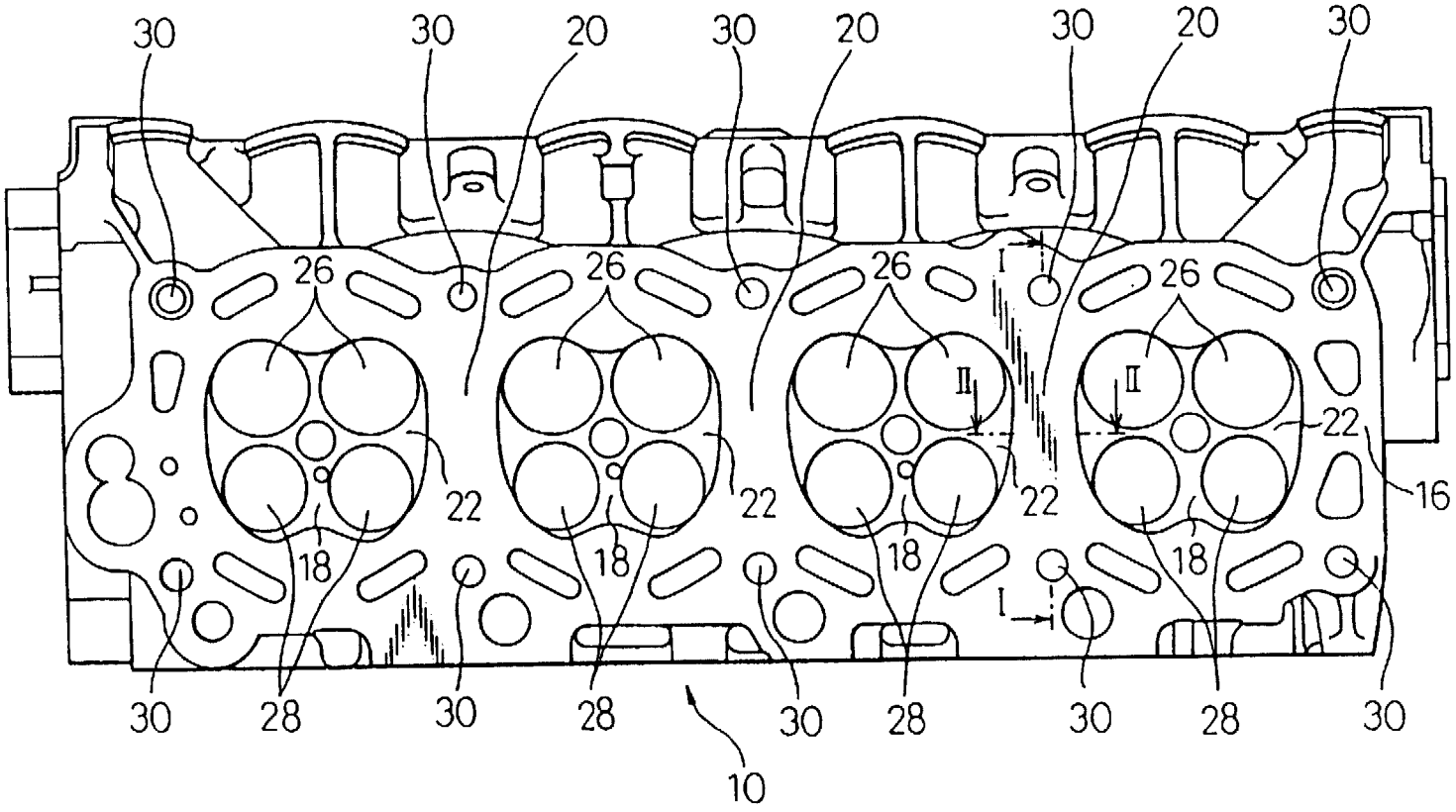
Fig. 8 Prior Art
FIG. 8 is a bottom side view of the conventional cylinder head without the slits or cavities.
Figure 9:
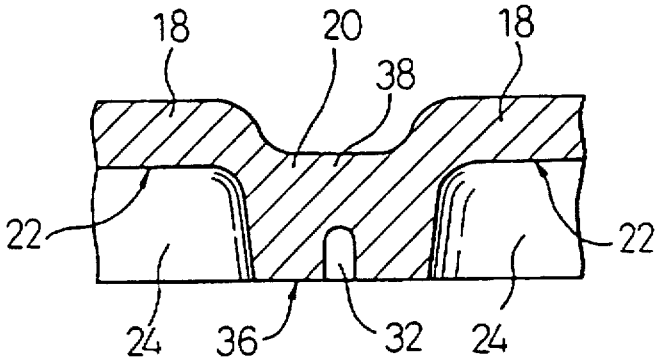
Fig. 9 Prior Art
FIG. 9 is a cross sectional view of the slit of the conventional cylinder head.
Figure 10:
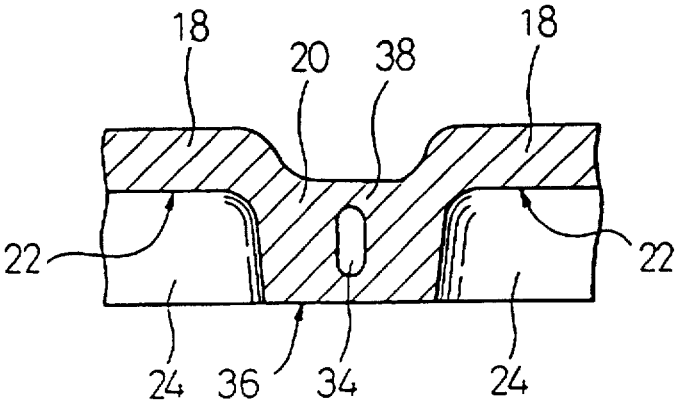
Fig. 10 Prior Art
FIG. 10 is a cross sectional view of the cavity of the conventional cylinder head.
Figure 11:
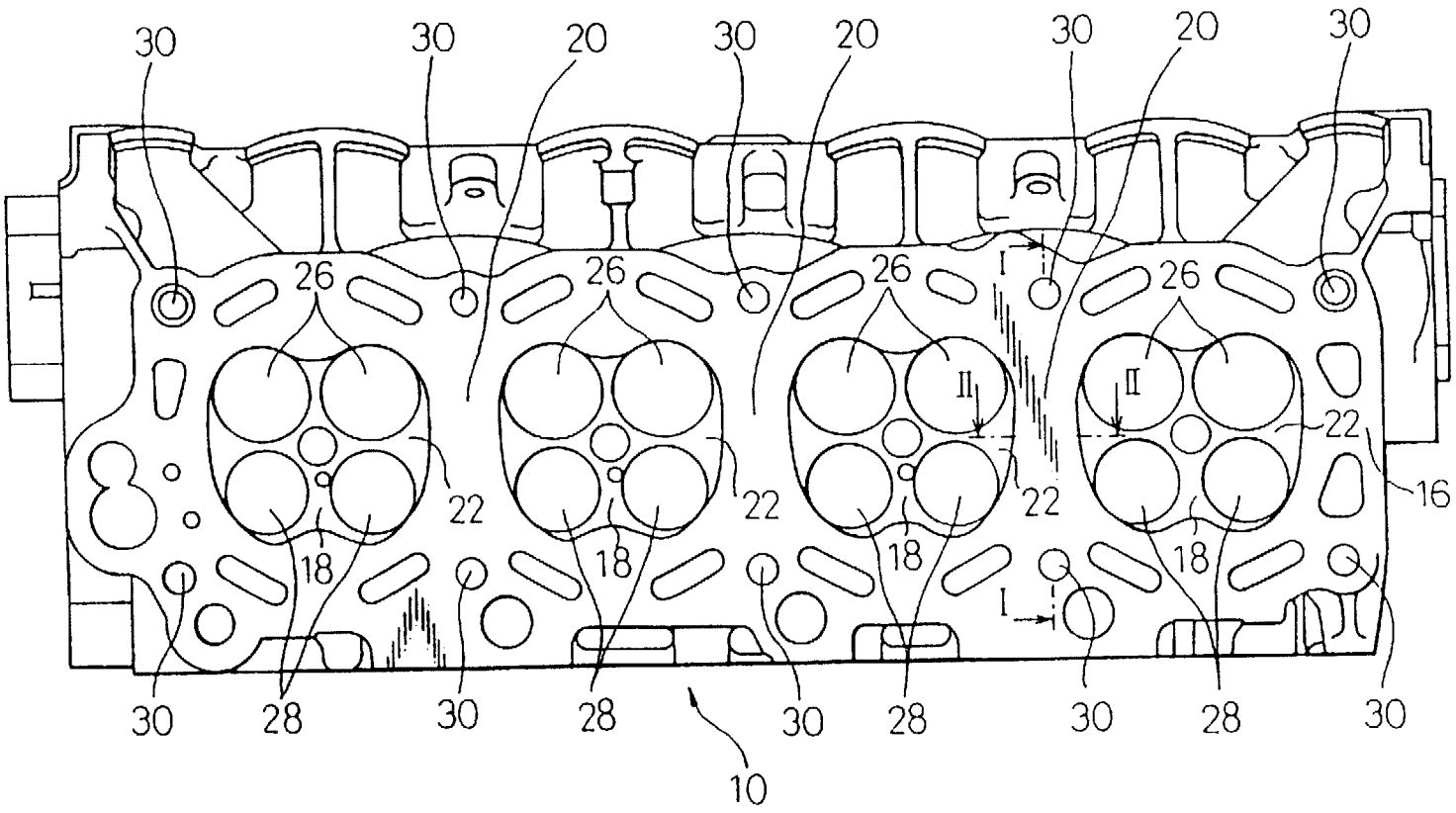
FIG. 11 is a bottom side view of a cylinder head according to the present invention not showing any slits or cavities.

A cylinder head according to of the invention as shown in FIG. 11 is generally the same as the conventional cylinder head 10 shown in FIG. 8, except for the arrangement of the slits. The cylinder head 10 generally comprises an upper wall 12, side walls 14, and a bottom wall 16. These walls 12, 14 and 16 define a waterjacket through which coolant for cooling the cylinder head 10 flows. The bottom wall 16 has spaced recessed wall portions 18 and a bottom wall portion 20 formed between the recessed wall portions 18. The recessed wall portions 18 have lower faces 22 defining upper spaces 24 of adjacent combustion chambers 25. Each of the recessed wall portions 18 has an intake valve port opening 26 and an exhaust valve port opening 28. The intake valve port openings 26 are arranged on one side of a plane including axes of cylinders 31 and the exhaust valve port openings 28 are arranged on the other side of the plane including axes of the cylinders 31. The bottom wall portion 20 divides the upper spaces 24 of the adjacent combustion chambers 25. The cylinder head 10 is attached to an engine body block 27 via a bracket 29 by screwing a bolt or the like into each bolt hole 30 provided in the bottom wall 16. The bracket 29 serves to maintain a sealing between the cylinder head 10 and the engine body block 27.

Figure 1:
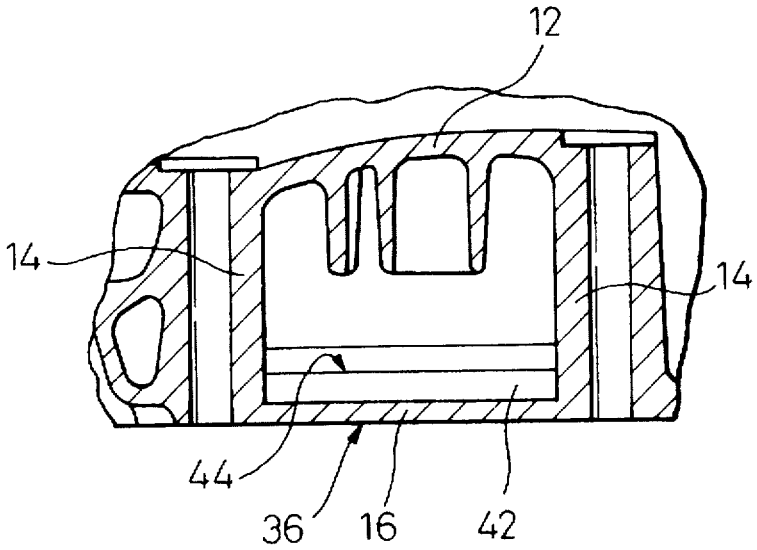
FIG. 1 is a cross sectional view of the first embodiment of the slit of the invention taken along the line I—I of the FIG. 11.
Figure 2:
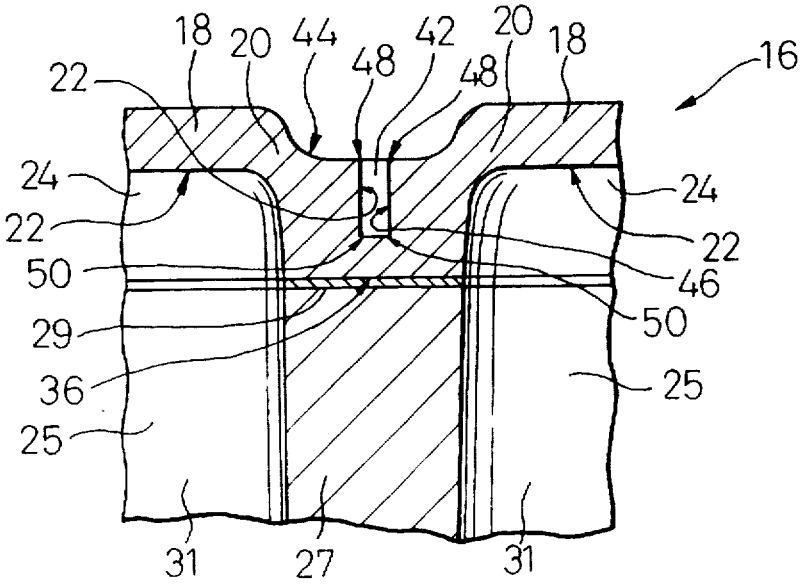
FIG. 2 is a cross sectional view of the first embodiment of the slit of the invention taken along the line II—II of FIG. 11.

Referring to FIGS. 1 and 2, the first embodiment of a slit of the invention is shown. In this embodiment, the slit 42 is formed on the upper face 44 of the bottom wall portion 20. The slit 42 extends within the bottom wall portion 20 toward a lower face 36 of the bottom wall portion 20 and extends in the transverse direction of the multi-cylinder engine. The slit 42 is defined by inner faces 46 of the bottom wall portion 20. The length of the slit 42 in the transverse direction of the multi-cylinder engine is generally equal to the width of the upper spaces 24 defined by the recessed wall portions 18 in the transverse direction of the multi-cylinder engine. The cross section of the slit 42, taken along the plane including axes of the cylinders 31, has a generally rectangular shape.

During the operation of the engine, the recessed wall portion 18 tends to expand outwardly from the center of the recessed wall portion 18 by the heat from the combustion chamber 25. Consequently, the upper edge portions 48 of the inner faces 46 of the bottom wall portion 20 are moved toward each other by the effect of the opposed longitudinal expansions of the recessed wall portions 18. According to this embodiment, the opposed longitudinal expansions of the recessed wall portions 18 are absorbed by the slit 42. Therefore, this embodiment limits the production of the thermal stress derived from the opposed longitudinal expansions, and accordingly, limits the production of cracks in the recessed and bottom wall portion due to the thermal stress.

Figure 3:
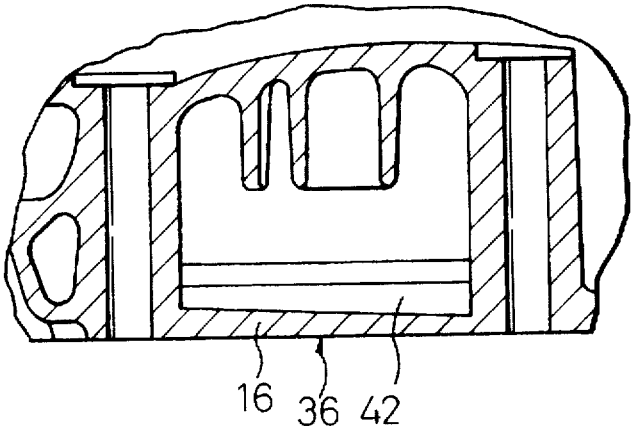
FIG. 3 is a cross sectional view of the second embodiment of the slit of the invention taken along the line A—A of the FIG. 8.

FIG. 3 is a cross sectional view of the second embodiment of the slit of the invention. The extent of the longitudinal expansion of a portion of the recessed wall portion 18, which is positioned near the exhaust valve port openings 28, is larger than that of a portion of the recessed wall portion 18, which is positioned near the intake valve port openings 26 since the temperature of the portions positioned near the exhaust valve port openings 28 is greater than that of the portions positioned near the intake valve port openings 26. In this embodiment, in consideration of the above difference of the extent of the longitudinal expansions depending on the temperature, the depth of a portion of the slit 42, which is positioned near the exhaust valve port openings 28, is greater than that of a portion of the slit 42 which is positioned near the intake valve port openings 26. The greater the distance between the upper and lower edges 48 and 50 of the inner face 46 is, the larger the possible extent of the movement of the upper edge 48 of the inner face 46 is. According to this embodiment, the larger longitudinal expansion can be sufficiently absorbed by providing the slit 42 with a portion having a greater depth. Therefore, this embodiment better limits production of the thermal stress derived from the opposed longitudinal expansions of the recessed and bottom wall portions than does the first embodiment.

Figure 4:
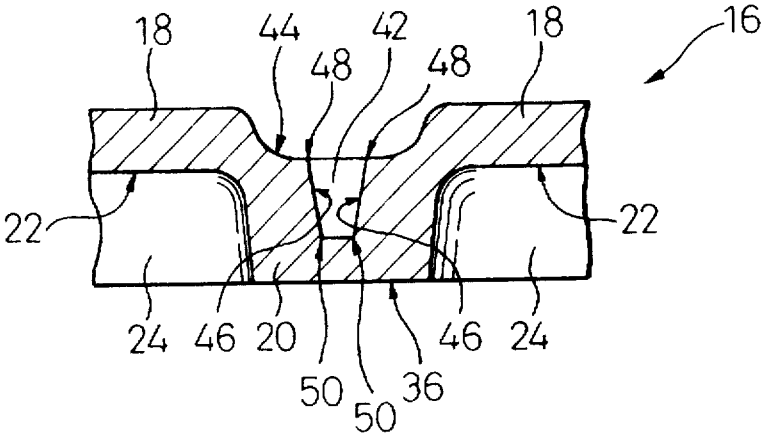
FIG. 4 is a cross sectional view of the third embodiment of the slit of the invention taken along the line II—II of FIG. 11.

FIG. 4 is a cross sectional view of the third embodiment of the slit of the invention. The extent of the movement of the upper edge 48 of the inner face 46 of the bottom wall portion 20 by the effect of the longitudinal expansion of the recessed wall portion 18 is larger than that of the lower edge 50 of the inner face 46. In this embodiment, in consideration of the above difference of the extent of the movements depending on the edges 48 and 50 of the inner face 46, the cross section of the slit 42, taken along the plane including axes of the cylinders 31 has an inverted trapezoidal shape. According to this embodiment, the possible extent of the movement of the upper edge 48 of the inner face 46 is longer than that of the lower edge 50 of the inner face 46. Therefore, this embodiment provides the better limited production of the thermal stress derived from the opposed longitudinal expansion of the recessed and bottom wall portions than the first embodiment.

Figure 5:
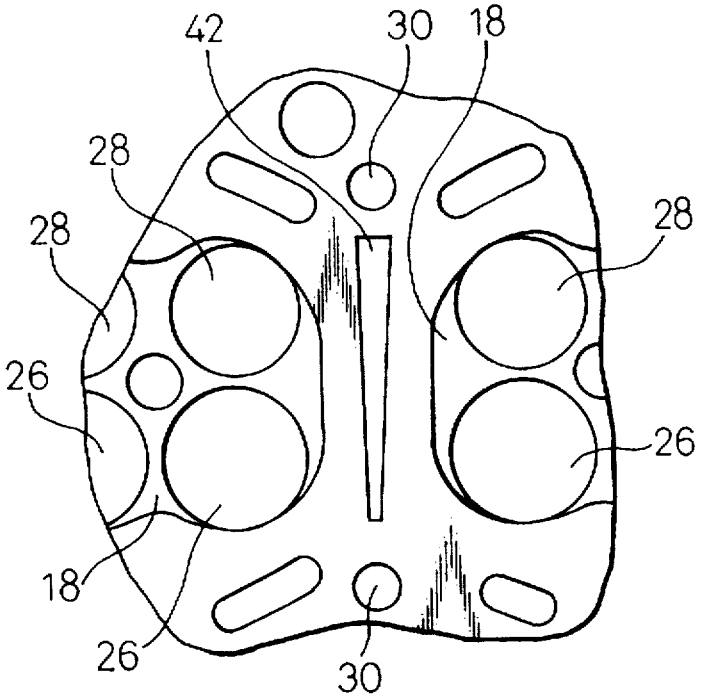
FIG. 5 is a top view of the fourth embodiment of the slit of the invention.

FIG. 5 is a top view of the bottom wall of the cylinder head including the forth embodiment of the slit of the invention. For the reason described above, the extent of the longitudinal expansion of a portion of the recessed wall portion 18, which is positioned near the exhaust valve port openings 28, is larger than that of a portion of the recessed wall portion 18, which is positioned near the intake valve port openings 26. In this embodiment, the width of a portion of the slit 42, which is positioned near the exhaust valve port openings 28 is greater than that of a portion of the slit 42, which is positioned near the intake valve port openings 26. According to this embodiment, the larger longitudinal expansion can be sufficiently absorbed by providing the slit 42 with a portion having a greater width. Therefore, this embodiment better limits the production of the thermal stress derived from the opposed longitudinal expansion of the recessed and bottom wall portions than does the first embodiment.

Figure 6:
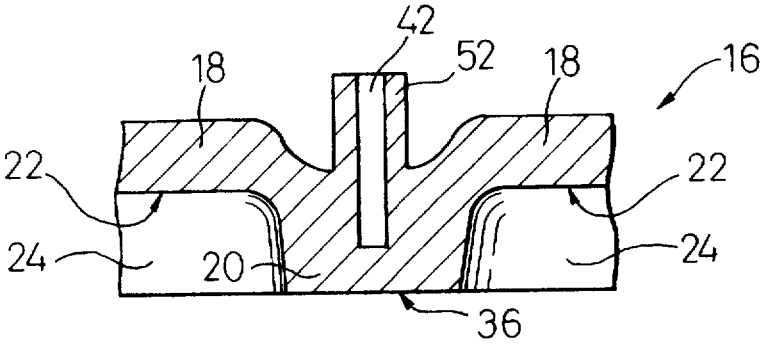
FIG. 6 is a cross sectional view of the fifth embodiment of the slit of the invention.

FIG. 6 is a cross sectional view of the fifth embodiment of the slit of the invention. In this embodiment, an upwardly projecting rib 52 is formed on the upper face 44 of the bottom wall portion 20. The rib 52 reinforces the cylinder head 10. The slit 42 extends through the rib 52 in the up-and-down direction. Therefore, this embodiment better limits the production of the thermal stress derived from the opposed longitudinal expansion of the recessed and bottom wall portions, and the enhances the rigidity of the cylinder head 10.

Figure 7:
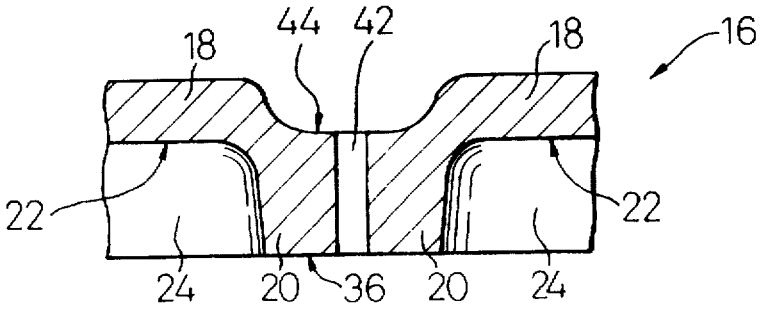
FIG. 7 is a cross sectional view of the sixth embodiment of the slit of the invention.

FIG. 7 is a cross sectional view of the sixth embodiment of the slit of the invention. In this embodiment, the slit 42 extends through the bottom wall portion 20 of the cylinder head 10. Sealing between the waterjacket 40 and combustion chamber 25 is accomplished by a bracket 29 which is positioned between the cylinder head 10 and the engine body block 27. According to this embodiment, the possible longitudinal movement of the bottom wall portion 20 is easier than in the first embodiment. Therefore, this embodiment better limits the production of the thermal stress derived from the opposed longitudinal expansion of the recessed and bottom wall portions than the first embodiment.

While the invention has been described by reference to specific embodiments chosen for purposes of illustration, it should be apparent that numerous modifications can be made thereto by those skilled in the art without departing from the basic concept and scope of the invention.

We claim:

1. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, and wherein said bottom wall has a bottom wall portion formed between said recessed wall portions to divide the upper spaces of the adjacent combustion chambers; and a slit extending from an opening formed in the upper face of said bottom wall portion toward a lower face of said bottom wall portion to a lower slit surface formed within said bottom wall portion.

2. A cylinder head for a multi-cylinder internal combustion engine according to claim 1, wherein said slit extends in a transverse direction of the multi-cylinder engine.

3. A cylinder head for a multi-cylinder internal combustion engine according to claim 1, wherein the cross section of said slit, taken along a plane including axes of cylinders has a generally rectangular shape.

4. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, said bottom wall having a bottom wall portion formed between said recessed wall portions to divide the upper spaces of the adjacent combustion chambers; and a slit formed on the upper face of said bottom wall portion and extending within said bottom wall portion and extending within said bottom wall portion toward a lower face of said bottom wall portion, wherein a length of said slit is generally equal to the width of said upper spaces defined by said recessed wall portions in a transverse direction of the multi-cylinder engine.

5. A cylinder head for a multi-cylinder internal combustion engine according to claim 4, wherein said slit extends through said bottom wall portion.

6. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, said bottom wall having a bottom wall portion formed between said recessed wall portions to divide the upper spaces of the adjacent combustion chambers; and a slit formed on the upper face of said bottom wall portion and extending within said bottom wall portion and extending within said bottom wall portion toward a lower face of said bottom wall portion, wherein each of said recessed wall portions has an intake valve port opening and an exhaust valve port opening, and wherein said intake valve port openings of said recessed wall portions are arranged on one side of a plane including axes of cylinders and said exhaust valve port openings of said recessed wall portions are arranged on the other side of the plane including axes of the cylinders, the depth of a portion of said slit which is positioned near said exhaust valve port openings is greater than that of a portion of said slit which is positioned near said intake valve port opening.

7. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, said bottom wall having a bottom wall portion formed between said recessed wall portions to divide the upper spaces of the adjacent combustion chambers; and a slit formed on the upper face of said bottom wall portion and extending within said bottom wall portion and extending within said bottom wall portion toward a lower face of said bottom wall portion, wherein each of said recessed wall portions has an intake valve port opening and an exhaust valve port opening, and wherein said intake valve port openings of said recessed wall portions are arranged on one side of a plane including axes of cylinders and said exhaust valve port openings of said recessed wall portions are arranged on the other side of the plane including axes of the cylinders, and the width of a portion of said slit which is positioned near said exhaust valve port openings is wider than that of a portion of said slit which is positioned near said intake valve port opening.

8. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, said bottom wall having a bottom wall portion formed between said recessed wall portions to divide the upper spaces of the adjacent combustion chambers; and a slit formed on the upper face of said bottom wall portion and extending within said bottom wall portion and extending within said bottom wall portion toward a lower face of said bottom wall portion, wherein the cross section of said slit, taken along a plane including axes of cylinders, has an inverted trapezoidal shape.

9. A cylinder head for a multi-cylinder internal combustion engine, comprising:

a bottom wall having an upper face which defines a waterjacket, said bottom wall having spaced recessed wall portions which have lower faces defining upper spaces of adjacent combustion chambers, said bottom wall having a bottom wall portion formed between said recessed wall portions to divide the upper spaces of the adjacent combustion chambers; and a slit formed on the upper face of said bottom wall portion and extending within said bottom wall portion and extending within said bottom wall portion toward a lower face of said bottom wall portion, wherein an upwardly projecting rib is formed on the upper face of said bottom wall portion, and said slit extends through said rib.

* * * * *